United States Patent [19]

Strausak

[11] 3,979,788

[45] Sept. 14, 1976

[54] MOBILE MACHINE FOR CLEANING SWIMMING POOLS

[75] Inventor: Benedikt Strausak, Burgdorf, Switzerland

[73] Assignee: Bieri Pumpenbau A.G., Munsingen, Switzerland

[22] Filed: July 3, 1975

[21] Appl. No.: 592,926

[30] Foreign Application Priority Data

July 5, 1974 Switzerland ..... 9389/74
Apr. 21, 1975 Switzerland ..... 6603/75

[52] U.S. Cl. ..... 15/1.7; 15/319
[51] Int. Cl.[2] ..... E04H 3/20
[58] Field of Search ..... 15/1.7, 387, 319; 210/169; 114/222

[56] References Cited

UNITED STATES PATENTS 3,229,315 1/1966 Watson ..... 15/1.7
3,676,885 7/1972 Wulc ..... 15/1.7
3,790,979 2/1974 Foster ..... 15/1.7

*Primary Examiner*—Edward L. Roberts
*Attorney, Agent, or Firm*—McCaleb, Lucas & Brugman

[57] ABSTRACT

A mobile machine for cleaning swimming pools by suction removal of sediment from the bottom of the swimming pools comprises a water turbine driving a drive wheel in such a way that the machine follows a self-steered path on the bottom of the swimming pools. The drive wheel is capable of rotating about a vertical steering axle to prevent the machine from becoming blocked at a wall or in a corner of the swimming pools.

11 Claims, 9 Drawing Figures

MOBILE MACHINE FOR CLEANING SWIMMING POOLS

This invention relates to a mobile machine for cleaning swimming pools by suction removal of sediment from the pool bottom, comprising a circulating pump, a suction line connected to the pump, a water turbine, and at least one drive wheel driven by the turbine, the suction line comprising a suction hose, and the machine being powered by the pump via the suction line and being capable of self-steered travel on the pool bottom for picking up the sediment and conveying it away through the suction hose.

As is well known, the main part of the work of cleaning an indoor or outdoor swimming pool consists in removing the sedimentary material which accumulates at the bottom of the pool. For that purpose, various suction-type cleaning devices have been developed which have to be guided systematically over the pool bottom by hand, using a long handle. Also known is electrically-driven cleaning equipment which operates on the vacuum-cleaner principle by suction and filtration of the water and which cleans the bottom of the pool by reversing whenever it encounters a wall of the pool.

Furthermore, German Utility Model No. 7,140,569 describes a device for vacuuming the bottoms of swimming pools which comprises a double-slotted water suction nozzle and an undercarriage. The undercarriage is driven via a turbine and a changeover gear. The power required for both suction of the sediment and for propelling the device is supplied by the suction flow. The device further comprises a steering rod which is displaceable in the direction of travel and projects out beyond either the one or the other side of the device. Whenever the device moves up toward a wall, the steering rod strikes the wall first and is thereby moved into its other position. This actuates the changeover gear, so that the device then travels on in the opposite direction.

This device works quite satisfactorily up to a certain point. However, in the corners of the swimming pool, or particularly when the pool has an irregular shape, the device becomes blocked by itself.

It is the object of this invention to provide a mobile machine of the kind initially described which does not become blocked even under difficult conditions and which, even in the case of swimming pools having an irregular shape, will almost certainly travel at least once over every point of the entire bottom area of the swimming pool.

To this end, the machine according to the present invention further comprises a steering axle disposed substantially at a right angle to the axis of rotation of the drive wheel, at least two free-running wheels, and at least one suction nozzle disposed on the underside of the machine, the drive wheel being adapted to rotate for causing travel of the machine and simultaneously to swivel about the steering axle for ensuring the self-steering of the machine.

Two preferred embodiments of the invention will now be described in detail with reference to the accompanying drawings in which.

Figure 5:
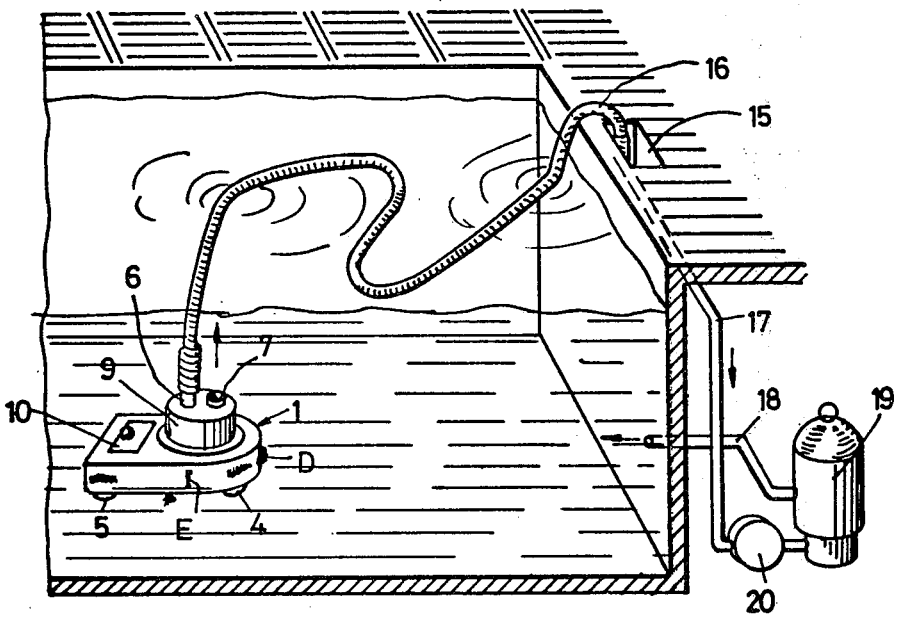
FIG. 5 is a perspective view of the mobile machine at the bottom of a swimming pool.

The swimming pool is cleaned by a machine 1 travelling over the bottom of the pool (see FIG. 5). Machine 1 is connected to a suction hose 16 via a rotatable coupling pipe 6 and is powered by a circulating pump 20 through a so-called skimmer connection 15 and via a suction line 17. All sedimentary material picked up by machine 1 passes along the route just described until it reaches a filter unit 19 where it is retained. The purified water flows back into the pool through an inlet pipe 18.

Figure 1:
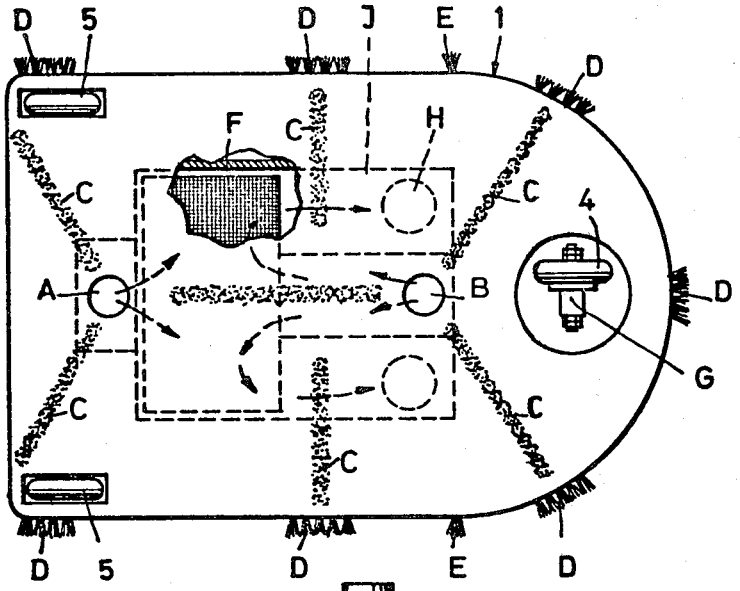
FIG. 1 is an inverted-plan view of the mobile machine.

FIG. 1 shows machine 1 with water suction nozzles A and B, several bottom-brushes C, and corner-brushes D disposed on its underside, side, and wall-brushes E disposed on its sidewalls. The dash-lines indicate water chambers inside machine 1. Arrows in FIG 1 indicate the paths along which the water flows. From suction nozzles A and B, the water flows upward through the middle chambers near nozzles A and B to a prefilter F, down through the latter into side chambers J, and up through two holes H into a turbine chamber 9.

A filter cover 10 (FIG. 3) is secrewed to a coverplate 12 of machine 1 via a ball end 11. A control knob 7 having a black-and-white marking is set on a shaft 8 of a turbine 21 and rotates continuously during operation to indicate that turbine 21 is functioning properly.

Figure 7:
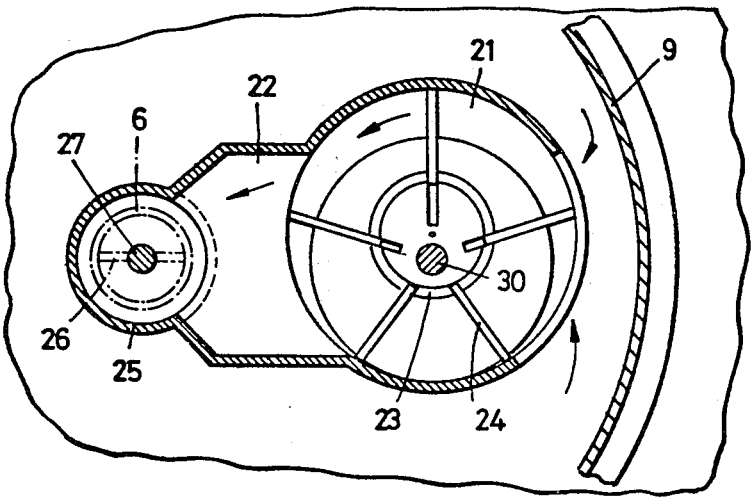
FIG. 7 is a section taken on the line VII—VII of FIG. 6.

Machine 1 is driven via eccentric vane turbine 21, which is housed in turbine chamber 9, and a cross-section of which is shown in FIG. 7. Similar designs are known for pumps, the return of vanes 24 of turbine 21 being effected by springs or by centrifugal force. Particularly advantageous is the return of vanes 24 by means of two return rings 23 disposed one on each side of vanes 24 (only one ring 23 being visible in FIG. 7), which rings ensure reliable operation with a minumum of friction.

As shown in FIG. 7, the rings 23 are eccentric of the shaft 30. The vanes 24 are carried around with the turbine 21 and are constrained to move radially in and out by suitable connections between their inner ends and the rings 23.

The water which has flowed into turbine chamber 9 now flows in the direction indicated by arrows through turbine 21, setting the latter in motion. A connecting duct 22 conveys the water into an outlet chamber 25, and from there it flows through rotatable coupling pipe 6 into suction hose 16.

In order that the mobility of machine 1 may be hindered as little as possible by suction hose 16, coupled pipe 6 is made integral with a centering shaft 27 by means of two spacers 26 and is centered and rotatably held by a lower bearing washer 28. An upper centering bearing 29 holds coupling pipe 6 in such a way that it may rotate smoothly, and also prevents water from leaking either in or out.

Figure 6:
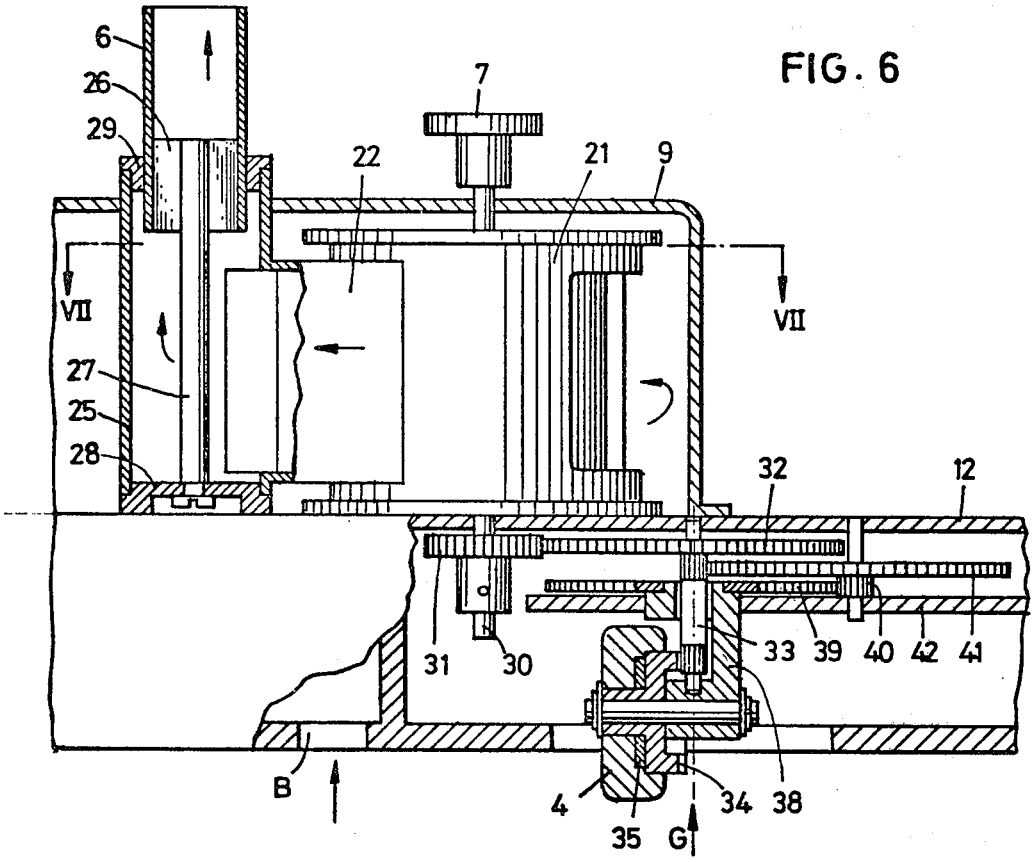
FIG. 6 is a partial sectional through the steering mechanism of the machine.

As shown in FIG. 6, turbine 21 drives via shaft 30 a gear-wheel 31 which meshes with a main gear 32. Main gear 32 is rigidly secured to a pinion spindle 33 and transmits its driving force via an angular gear-wheel or bevel gear 34 and a clutch-disk 35 to a drive wheel 4 which drives machine 1 over the bottom of the pool.

As may also be seen in FIG. 6, the steering arrangement is such that while machine 1 is moving along, drive wheel 4 swivels about an associated steering axle G disposed perpendicular to the axis of rotation of drive wheel 4. This is accomplished by means of rigidly interconnected reduction gear-wheels 40 and 41 which, driven by pinion spindle 33, cause a steering gear-wheel 39, having a support 38 mounted in a bearing plate 42, to rotate about steering axle G.

Figure 4:
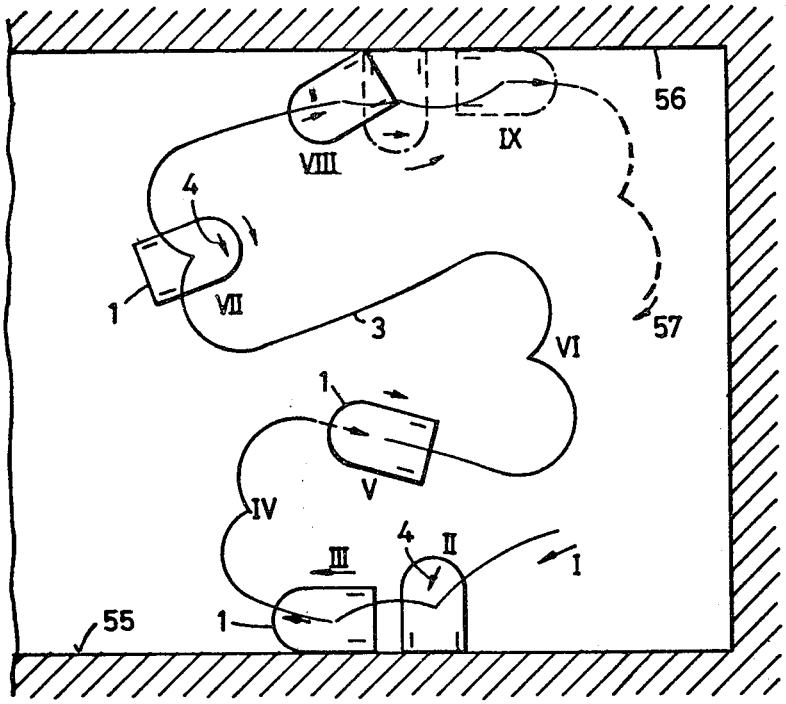
FIG. 4 is a plan view of part of a swimming pool, showing a path of travel of the machine.

Thus drive wheel 4 constantly changes direction during operation and steers machine 1 along a path 3, shown in FIG. 4, over the bottom of the pool. Whenever machine 1, coming from any direction, e.g., from position I, reaches a wall 55 of the swimming pool, drive wheel 4 (FIG. 6) becomes blocked, and machine 1 stands still. The drive mechanism, disengaged by the slip clutch 35, continues to rotate and steers drive wheel 4 in another direction. In FIG. 4, the direction of advance of drive wheel 4 is indicated in each instance by a small arrow. When drive wheel 4 is indicated in each instance by a small arrow. When drive wheel 4 has swiveled further into a direction parallel to wall 55, machine 1 will turn through a short curve from position II to position III and remain there until drive wheel 4 has swiveled by another 90°. When drive wheel 4 is again in a position parallel to wall 55, it begins to pull machine 1 away from wall 55 and to steer it through the pool along the heart-shaped path 3; the system employed will necessarily cause machine 1 to rotate once about its own axis in each of the positions IV, VI, and VII. It will also travel alternately forward and backward until it reaches wall 56 in position VIII. After it has turned again, as before, into position IX, the whole procedure begins anew in the direction indicated by arrow 57. The conditions determining the path of travel and reversing are such that machine 1 cannot become caught in any corner of the pool and always moves away from the walls.

The machine described above is coercively steered and repeats an identical new cycle after each revolution of drive wheel 4 about its axle G. Should it occur that, in the case of a swimming pool of a certain size, the machine happens to arrive in the same position and facing in the same direction of travel when it reaches the next wall after following path 3 shown in FIG. 4, it will then travel along the same path over and over again and will consequently not clean the entire bottom of the pool.

In order to eliminate this difficulty, provision is made for an interference gear which irregularly varies the course of path 3 during each revolution of drive wheel 4 about axle G. A repetition of the steering procedure will not occur again until after 150 cycles, for instance, thus making it impossible for an identical path of travel to be followed.

Figure 8:
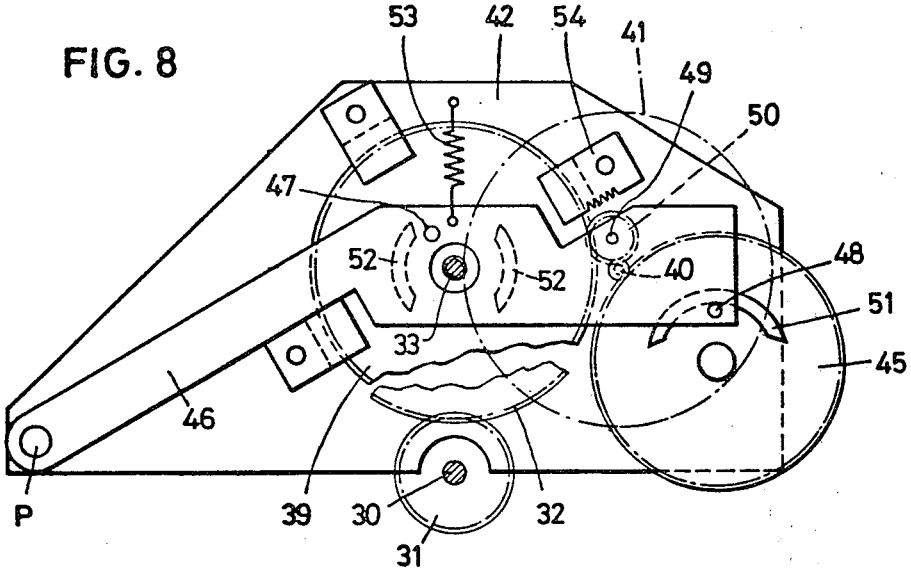
FIG. 8 shows part of another design of the gearing for the driving wheel.

According to the present invention, the aforementioned interference gear, which will be described below with reference to FIG. 8, is to be inserted between the meshing steering gear-wheel 39 and reduction gear-wheel 40.

Main gear 32 seated on pinion spindle 33 is driven via turbine gear-wheel 31 and meshes with reduction gear-wheel 41 which, in turn, transmits the rotary motion via reduction gear-wheel 40 to a segmental control gear 45 having a segment 51.

A shift lever 46 is provided with two control pins 47 and 48 and with a shift gear 50 mounted on a bearing pin 49 and meshing with reduction gear-wheel 40. when shift lever 46 is pivoted about a bearing point P by a retractile spring 53, shift gear 50 is disengaged from gear-wheel 40, and lever 46 is pressed against a stop block 54.

During this small rotating movement of shift lever 46, shift gear 50 remains constantly engaged with steering gear-wheel 39. Stop block 54 is so designed that on the side of it facing shift gear 50, it, too, has teeth which engage with shift gear 50 and thus prevent both the latter and steering gear-wheel 39 from rotating. Hence the rotary movement about steering axle G is fixed and can no longer be varied from the moment. During this time, drive wheel 4 steers machine 1 in a straight line.

In this manner already described, segmental control gear 45, which preferably has a prime number of teeth, e.g., 127, continues to rotate, the result of which is that when control segment 51 reaches control pin 48, it pivots shift lever 46 clockwise, as viewed in FIG. 8, so that shift gear 50 comes into engagement with reduction gear-wheel 40, and steering gear-wheel 39 thus continues rotating to change the direction of travel until control segment 51 releases control pin 48 once more, and the procedure described above recommences.

In order that machine 1 may not just rotate about its own axis during the periods of movement having the shortest radius of turn, e.g., in positions IV, VI, or VII shown in FIG. 4, steering gear-wheel 39 is provided with two blocking segments 52 which, via control pin 47, hold shift lever 46 in its operative state and thus prevent the start of steering in a straight line in positions IV, VI, or VII.

Figure 3:
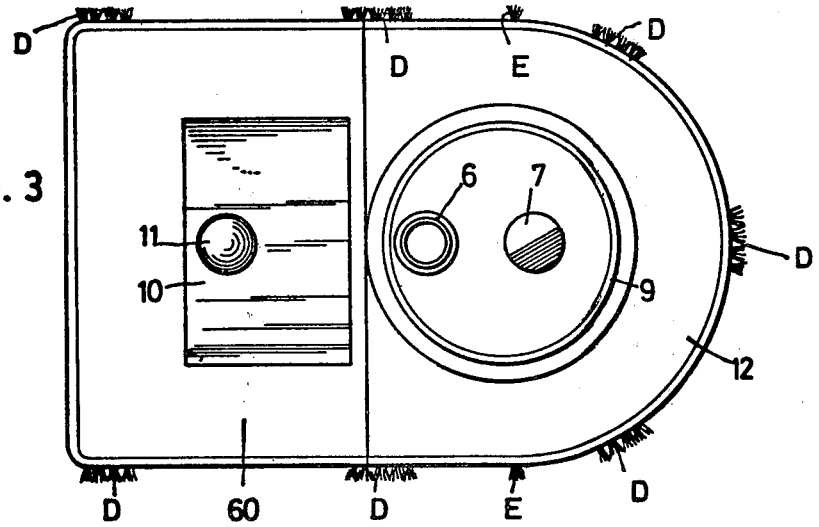
FIG. 3 is a top plan view of the machine of FIG. 1.

FIG. 3 shows a top plan view of machine 1, the entire rear part of which is used as a pre-filter and closed off by a part 60 of cover plate 12. This arrangement produces a large active filter area with a low flow-rate.

Figure 2:
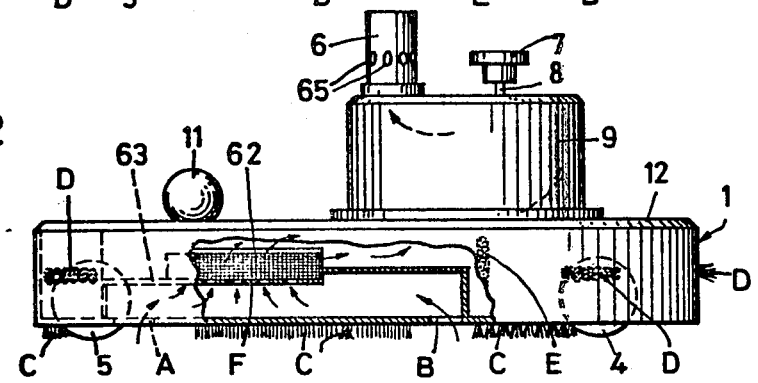
FIG. 2 is a side elevation of another embodiment of the machine of FIG. 1.

In the embodiment shown inn FIG. 2, the water flows upward through the filter from below, in the direction indicated by arrows; the heavier sediment therefore remains lying at the bottom of machine 1, owing to the weakness of the current, and begins to be deposited from the bottom up. The capacity of the prefilter is thereby greatly multiplied as compared with that of the prior art.

Preferably, a fine-pored filter medium 62, which may, for example, consist of a foamed substance, is laid in a coarse-mesh filter basket 63 which can be swung open for replacement of filter medium 62.

Figure 9:
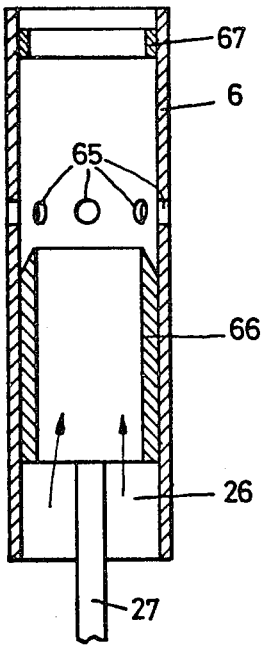
FIG. 9 is a section through the coupling pipe of the machine, to which pipe the suction hose is attached.

Furthermore, a deviating sleeve 66 is disposed in coupling pipe 6 so that circulating pump 20 will not operate dry if drive turbine 21 ever becomes blocked or if the prefilter should be totally stopped up. FIG. 9 shows coupling pipe 6, which has a number of openings 65 in its peripheral surface. Inside pipe 6 is the freely-movable deviating sleeve 66, which always drops down by its own weight and leaves openings 65 free. If a current from below becomes operative (direction of arrows), it is drawn upward against a stop ring 67, thus closing off openings 65. In order to prevent flutter when the flow is cut off, the top of sleeve 66 is made frustoconical.

What is claimed is:

1. A mobile machine for cleaning swimming pools and the like by suction removal of sediment from the pool bottom comprising a mobile housing having a water turbine between inlet and outlet chambers, at least two pool-bottom-engaging free-running wheels positioned at one end of the underside of said housing, at least one pool-bottom-engaging drive wheel driven by said turbine positioned at the opposite end of the underside of said housing, said turbine adapted to be driven to rotate said drive wheel by a suction applied to a hose connected between an external circulating pump and an outlet coupling pipe on said housing communicating with said outlet chamber, said machine having at least one suction nozzle on the underside of said housing communicating with said inlet chamber, said turbine being adapted to be powered by said pump via said suction line and thereby effective to draw water into said suction nozzle and discharge it through said coupling pipe into said suction hose, said drive wheel being carried on a steering support swivelably mounted on the underside of said housing, said steering support being swivable about a steering axis disposed substantially at a right angle to the axis of rotation of said drive wheel, separate power transmitting connections from said turbine to said drive wheel and to said steering support for simultaneously continuously positively rotating said drive wheel about it said axis of rotation while continuously positively swiveling said steering support about its said steering axis for automatically moving said machine in different directions across said pool bottom and ensuring self-steering of said machine while removing sediment from said pool bottom.

2. A machine according to claim 1, including a slip clutch in said power transmitting connection from said water turbine to said drive wheel enabling said machine to stall against a pool wall while said clutch slips and while said steering support swivels to rotate said drive wheel to a position to move the machine away from the wall.

3. A machine according to claim 1, further comprising a plurality of brushes on side and bottom exterior surfaces of said housing for cleaning walls, corners, and said bottom of said swimming pools and the like.

4. A machine according to claim 1, wherein said turbine comprises a number of radially-movable vanes.

5. A machine according to claim 4, further comprising two eccentric return rings engaged with said vanes and disposed one on each side of said vanes for returning said vanes after radial movement thereof.

6. A machine according to claim 1, further comprising a freely-rotatable coupling pipe connecting said suction hose to said machine.

7. A machine according to claim 6, further comprising a sliding deviating sleeve disposed within said coupling pipe, said coupling pipe comprising transverse openings which can be closed off by said deviating sleeve.

8. A machine according to claim 7, wherein said deviating sleeve is vertically movable within said coupling pipe and is beveled at the top.

9. A machine according to claim 1 in which said power transmitting connection from said water turbine to said steering support includes at least one pair of gears, and means for intermittently engaging and disengaging said gears in response to operation of said water turbine for continuously varying said self-steering of said machine.

10. A machine according to claim 9, further comprising means for stopping swiveling of said steering support while said gears are disengaged to steer said machine in a straight line.

11. A machine according to claim 1, wherein said turbine comprises a shaft, further comprising a rotary knob seated on said shaft and having a distinctive marking for indicating under-water operation of said turbine.

* * * * *

UNITED STATES PATENT OFFICE

CERTIFICATE OF CORRECTION

PATENT NO. : 3,979,788

DATED : September 14, 1976

INVENTOR(S) : Benedikt Strausak

It is certified that error appears in the above-identified patent and that said Letters Patent are hereby corrected as shown below:

Col. 1, line 32, "for both" should be -- both for --

Col. 2, line 27, delete "side"

Col. 2, line 35, "secrewed" should be -- screwed --

Col. 2, line 62, "coupled" should be -- coupling --

Col. 4, line 20, "this" should be -- the --

Signed and Sealed this

Eighth Day of February 1977

[SEAL]

*Attest:*

RUTH C. MASON
*Attesting Officer*

C. MARSHALL DANN
*Commissioner of Patents and Trademarks*